US005417595A

United States Patent [19]

Cullen et al.

[11] Patent Number: 5,417,595

[45] Date of Patent: May 23, 1995

[54] METHOD AND APPARATUS FOR FREQUENTLY CONNECTING AND DISCONNECTING SIGNAL CABLES

[75] Inventors: W. Paul Cullen, Scotia; Pamela B. Wintermute, Ballston Spa, both of N.Y.

[73] Assignee: Applied Robotics, Inc., Schenectady, N.Y.

[21] Appl. No.: 52,081

[22] Filed: Apr. 22, 1993

[51] Int. Cl.[6] ..... H01R 13/24

[52] U.S. Cl. ..... 439/700; 439/824

[58] Field of Search ..... 439/700, 816–824, 439/289, 863

[56] References Cited

U.S. PATENT DOCUMENTS

| | | | |
|---|---|---|---|
| 513,949 | 1/1894 | Munson | 439/700 |
| 1,190,525 | 7/1916 | Douglas | 439/824 |
| 1,347,738 | 7/1920 | Douglas | 439/701 |
| 1,567,474 | 12/1925 | Tomlinson | 439/700 |
| 1,584,167 | 5/1926 | Camfield | 439/736 |
| 1,687,074 | 10/1928 | Wichert | 439/700 |
| 2,210,418 | 8/1940 | Larson | 173/324 |
| 2,644,145 | 6/1953 | Adams | 439/824 |
| 2,724,096 | 11/1955 | Klostermann | 439/824 |
| 3,171,183 | 3/1965 | Johnston | 439/824 |
| 3,676,776 | 7/1972 | Bauer et al. | 324/725 |
| 3,812,451 | 5/1974 | Buglewicz | 439/651 |
| 4,307,928 | 12/1981 | Petlock, Jr. | 439/824 |
| 4,358,175 | 11/1982 | Reid | 439/331 |
| 4,597,622 | 7/1986 | Coe | 439/863 |
| 4,620,761 | 11/1986 | Smith et al. | 439/372 |
| 4,664,588 | 5/1987 | Newell et al. | 414/730 |
| 4,686,465 | 8/1987 | Kruger | 324/158 |
| 5,076,794 | 12/1991 | Ganthier | 739/70 |
| 5,092,774 | 3/1992 | Milan | 439/66 |
| 5,151,040 | 9/1992 | Tanaka | 439/700 |

FOREIGN PATENT DOCUMENTS

| | | |
|---|---|---|
| 2729179 | 1/1979 | Germany . |
| 423359 | 1/1935 | United Kingdom . |
| 1454918 | 11/1976 | United Kingdom . |
| WO8200387 | 2/1982 | WIPO . |

OTHER PUBLICATIONS

Interconnect Devices, Inc. Data Sheet, 1993 Double Ended Probes and Receptacles.

1990 QA Technology Company, Inc. Data Sheet.

Augat Pylon Catalog #105B pp. 4, 18 and 26, Pylon Company, Inc., Attleboro Falls, Mass. 02763.

*Primary Examiner*—Daniel W. Howell
*Assistant Examiner*—Hien D. Vu
*Attorney, Agent, or Firm*—Frank J. Uxa

[57] ABSTRACT

Pin-and-socket signal cable connectors of the type exemplified by D-SUB series connectors can be quickly mated and unmated many thousands of times without damage to their terminals and without misalignment errors, by so forming the terminals of one or both of the connectors of a connector pair that they can move with respect to their connector body against a spring bias, and that the pins and sockets mate in abutting relationship rather than in frictional engagement. Modified connectors and adapters for standard connectors are disclosed.

11 Claims, 8 Drawing Sheets

METHOD AND APPARATUS FOR FREQUENTLY CONNECTING AND DISCONNECTING SIGNAL CABLES

FIELD OF THE INVENTION

This invention relates to connectors for signal cables, and more particularly to a method and apparatus for preserving the integrity of such connectors when they are mated and unmated many thousands of times.

BACKGROUND OF THE INVENTION

Multiline signal cable connectors such as the common D-SUB series are conventionally of a type in which a plurality of thin male pins (for example, 9, 15, 25, 37 or 50 thin male pins) extend axially through a cavity formed by a protective shield or wall into which a female plug with an equal number of sockets is inserted. In order to reliably make good contact for low-voltage signals, the contacting elements may be gold-plated or otherwise treated. The female sockets are usually formed as leaf springs which receive the pins in frictional engagement.

Connectors of this type are not meant to be mated and unmated very often, and in fact their typical life expectancy is about 500 mating cycles. Failure usually occurs because the frictional engagement damages one or more components of the connector, for example, wears the plating off or damages the pins or leaf springs.

It is often necessary, however, as for example in test equipment, rotating-head fabricating machines, etc., to connect and disconnect signal cables dozens or hundreds of times per day. In the past, this has required very frequent connector replacement or the use of expensive specially designed pairs of connectors strong enough to withstand such usage.

SUMMARY OF THE INVENTION

The present invention allows thousands, or even hundreds of thousands, of mating cycles to be made with ordinary, inexpensive complementary D-SUB-type or similar signal cable connectors by using modified terminals which preferably avoid or provide for reduced frictional contact. For this purpose, the invention envisions the use of a connector in which the terminals (pins or sockets or both) are movable within the connector against a bias assembly, preferably against the bias of a spring. In a preferred embodiment of the invention, the contacting surfaces of the sockets in a female connector are substantially transverse to the direction of movement of the contacting elements, so that the tips of the male pins make an abutting contact, rather than a frictional contact, with the sockets.

In another embodiment of the invention, an adapter set is provided which plugs into a pair of conventional connectors. The adapter set contains a pair of connector blocks, at least one of which is provided with biased, preferably spring-biased, contact pads which abut against the contact pads of the other block when the connector blocks are joined.

In yet a further embodiment of the present invention, a double-ended adapter for interconnecting signal cable connectors is provided. This adapter comprises a body, and a plurality of barrels disposed in the body, preferably substantially parallel to each other. Disposed in each of the barrels is a pair of axially spaced plungers mounted for limited axial movement with respect to the barrel. A biasing assembly, preferably a spring, is positioned to keep the plungers making up each pair of plungers apart from each other. One of the plungers making up each pair of plungers carries a male terminal, while the other plunger making up each pair of plungers carries a female terminal. This adapter can be used as a frequent mating connector with either a male or a female signal cable connector.

DESCRIPTION OF THE PREFERRED EMBODIMENT

Figure 1:
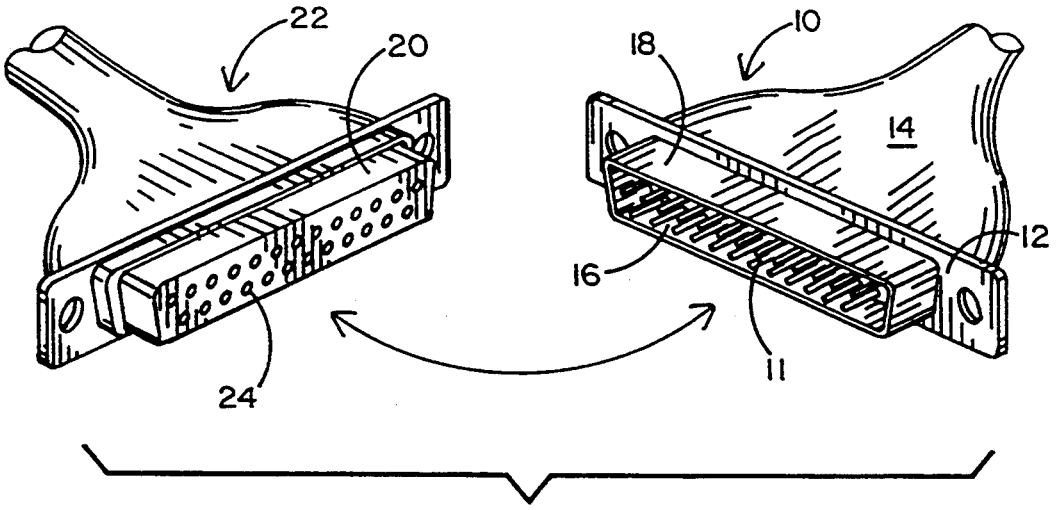
FIG. 1 is a perspective view of a pair of typical computer cable connectors in which the invention is useful.

The present invention relates to signal cable connectors, as for example those widely used computer cable connectors in which the male connector 10, as shown in FIG. 1, has a plurality of thin, generally cylindrical parallel male terminals or pins 11 protruding from the face 12 of a connector body 14. The pins 11 are recessed for protection into a cavity 16 formed by a protective shroud as in D-SUB-type connectors illustrated in FIG. 1. Alternately, a protective cavity can be formed by the body 14 itself. The body 20 of the female connector 22 is shaped so as to fit into the cavity 16, and to thereby guide the pins 11 into alignment with a corresponding number of female terminals or sockets 24.

Figure 2A:
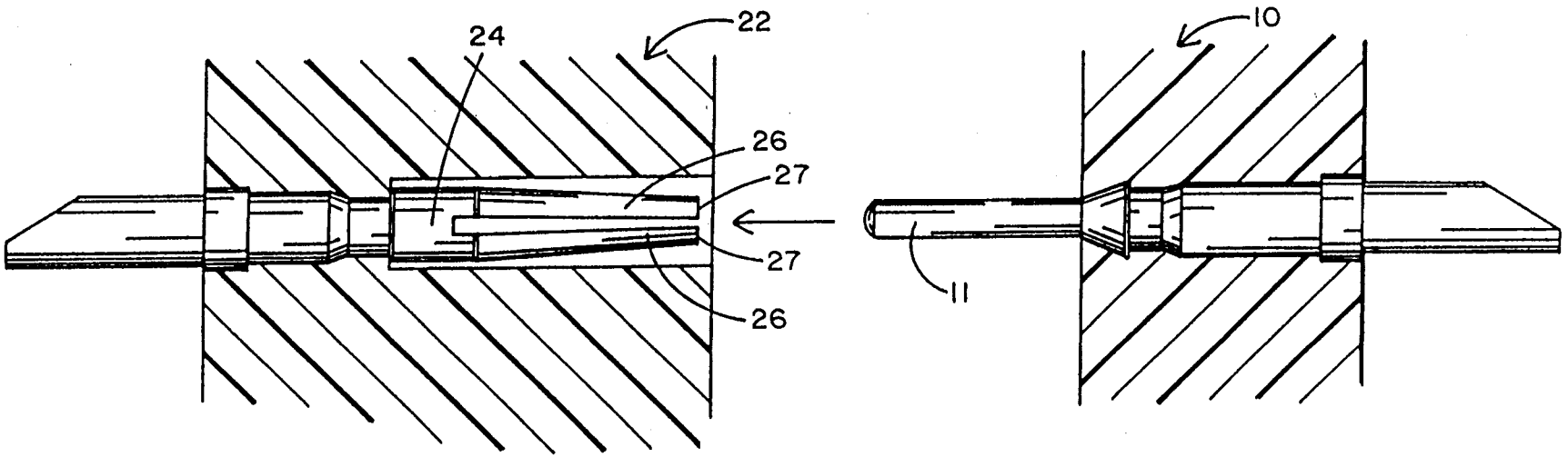
FIG. 2a PRIOR ART
FIG. 2*a* is a partial section, in the female connector of FIG. 1, of a conventional socket prior to its engagement with a pin.
Figure 2B:
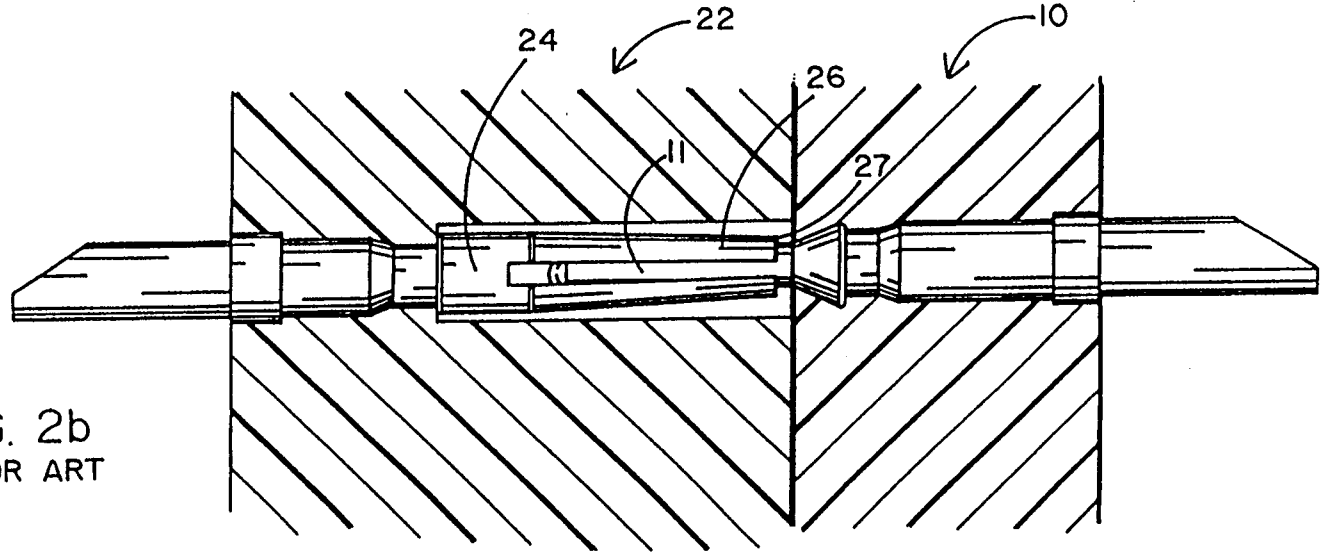
FIG. 2b PRIOR ART
FIG. 2*b* is a view similar to FIG. 2*a* but showing the socket frictionally engaged with a pin.

FIGS. 2*a* and 2*b* show in more detail how the pins 11 and sockets 24 are conventionally interengaged in connectors of this type. The socket 24 is provided with a pair of spring leaves 26 which are forced apart by the pin 11 when the connectors 10 and 22 are mated. The sides of pin 11 rub against the edges 27 of the leaves 26 both during mating and unmating. This frictional action, coupled with the fact that connectors are often carelessly aligned with each other before mating, soon damages the pins and/or the sockets and leads to an early failure of the connectors. Typically, conventional connectors of this type are essentially destroyed after a few hundred, for example, 500, mating cycles.

Figure 3A:
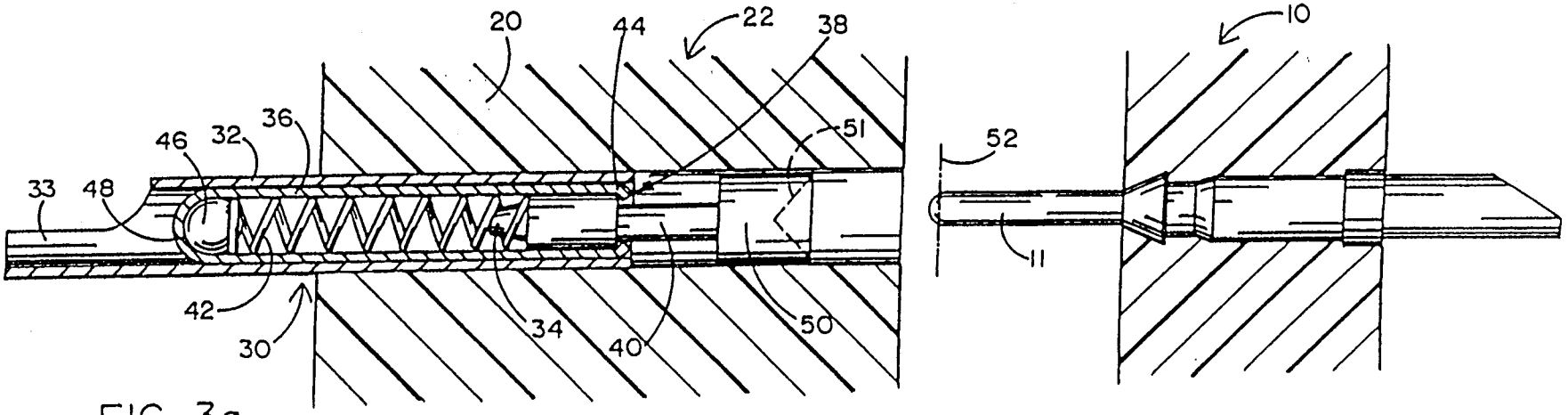
FIG. 3*a* is a view similar to FIG. 2*a* but showing a socket constructed in accordance with the invention.
Figure 3B:
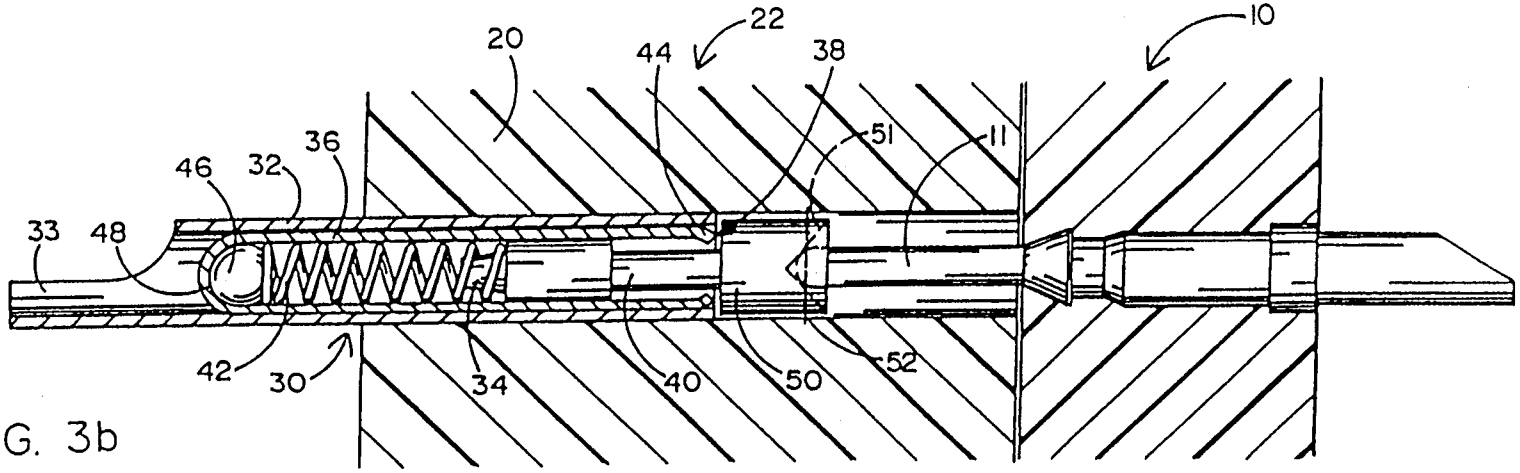
FIG. 3*b* is a view similar to FIG. 3*a* but showing the pin engaging the socket of FIG. 3*a;*

FIGS. 3*a* and 3*b* illustrate a modified socket 30 according to the invention. For the sake of clarity, only one modified socket 30 is illustrated. However, a plurality of modified sockets 30 are employed with the number of modified sockets 30 being the same as the number of sockets 24 of FIG. 1. A receptacle tube 32 ending in a connection element 33 is fixedly mounted in the body 20 of the female connector 22. The barrel 36 of a spring contact unit 38 (available commercially from a number of manufacturers such as QA Technology Co., Inc. of Hampton, N.H.) is then secured, for example, press-fitted, into the receptacle tube 32. A plunger 40 is telescopically movable in the barrel 36 against the bias of a spring 42 and is retained therein by a flange 44. Electric contact is made from the plunger 40 to the barrel 36 in any appropriate manner, as for example through the spring 42, one end of which may be press-fitted onto the inner tip 34 of plunger 40. The other end of spring 42 makes direct or indirect contact with the barrel 36, as for example by embracing a ball 46 which in turn makes contact with the hemispherical interior of the inner end 48 of barrel 36. The plunger 40, spring 42 and ball 46 (if used) are preferably made of, or plated with, a highly conductive material, such as gold or other highly conductive metal. Other reliable conventional contact technologies may, for example, involve a spring external of the barrel, a laterally biased ball between the plunger and the spring, a spring with no ball but bearing against flat surfaces on both of its ends (as in FIG. 8), or a ball at each end of the spring.

The contact head 50 of plunger 40 preferably has a substantially conical recess 51 which makes a firm annular contact in plane 52 with the tip of a typical D-SUB-type pin when the connector 22 is mated with a male connector 10 and the spring 42 is compressed.

Figure 4A:
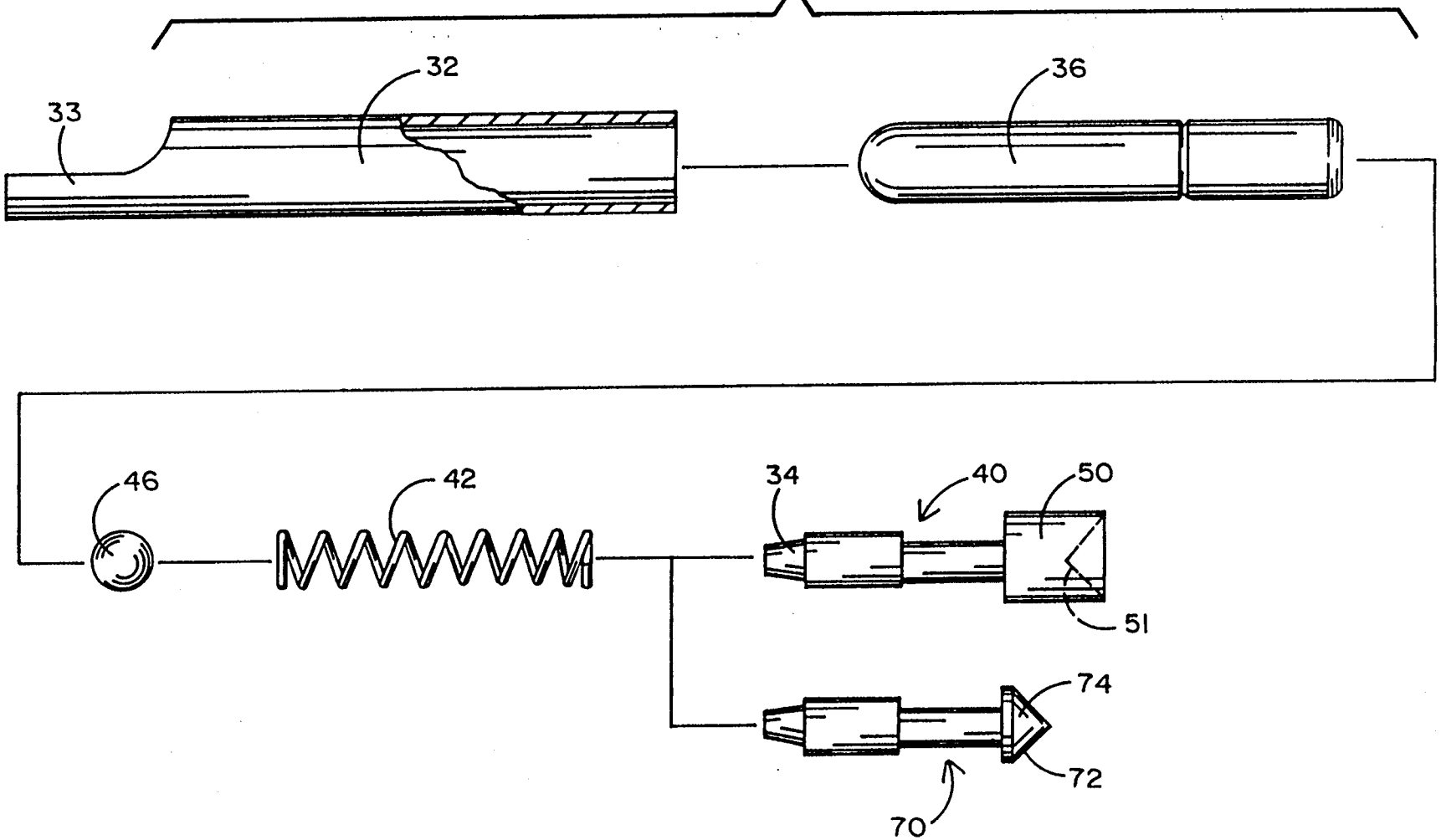
FIG. 4*a* is an exploded view of a portion of the inventive connector showing alternatively exploded male and female connectors constructed in accordance with the invention.
Figure 4B:
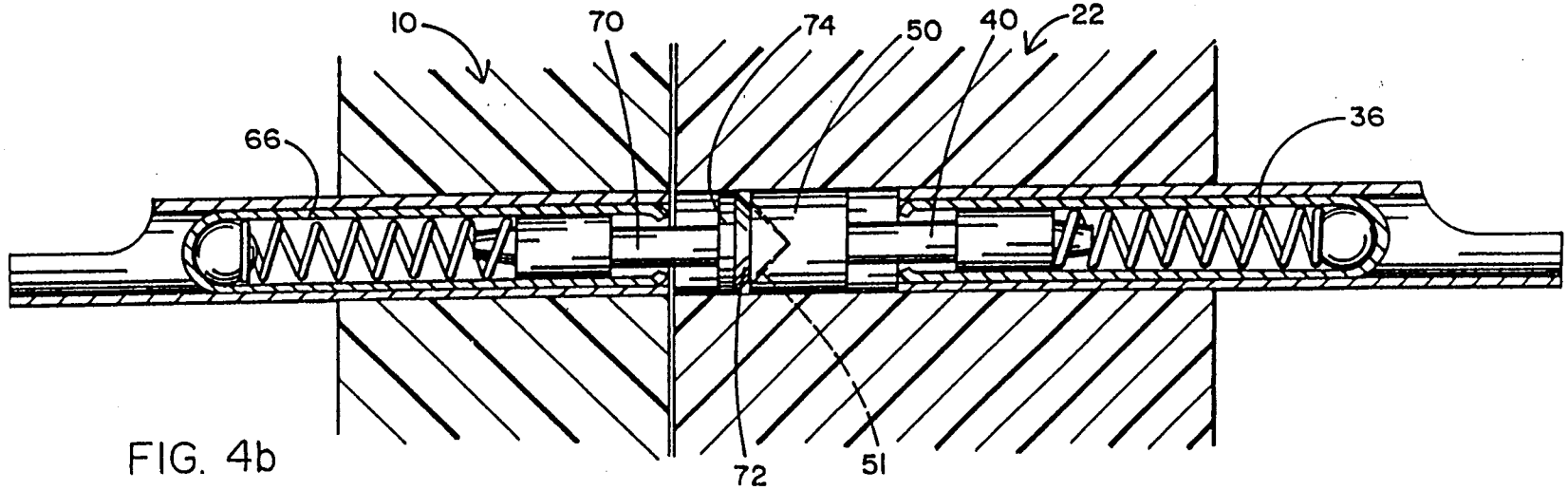
FIG. 4*b* is a sectional view showing a connection in which both the male and the female connectors are constructed in accordance with the invention.

FIG. 4*a* shows, in exploded form, how either a male connector or a female connector, or both, can be equipped with spring-loaded terminals. FIG. 4*b* further illustrates the point that a connector equipped with spring-loaded terminals need not necessarily be mated with conventional connectors. In FIG. 4*b*, both the male connector 10 and the female connector 22 are provided with spring-loaded terminals. Barrels 36, 66 and plungers 40, 70 are provided on the connectors 22, 10 respectively. The contact head 50 of the female plunger 40 and the contact head 74 of the male plunger 70 may advantageously have complementary conical mating surfaces 51, 72 (see also FIG. 4*a*) so that an area contact will be provided to give the connection a higher current-carrying capacity.

Figure 5C:
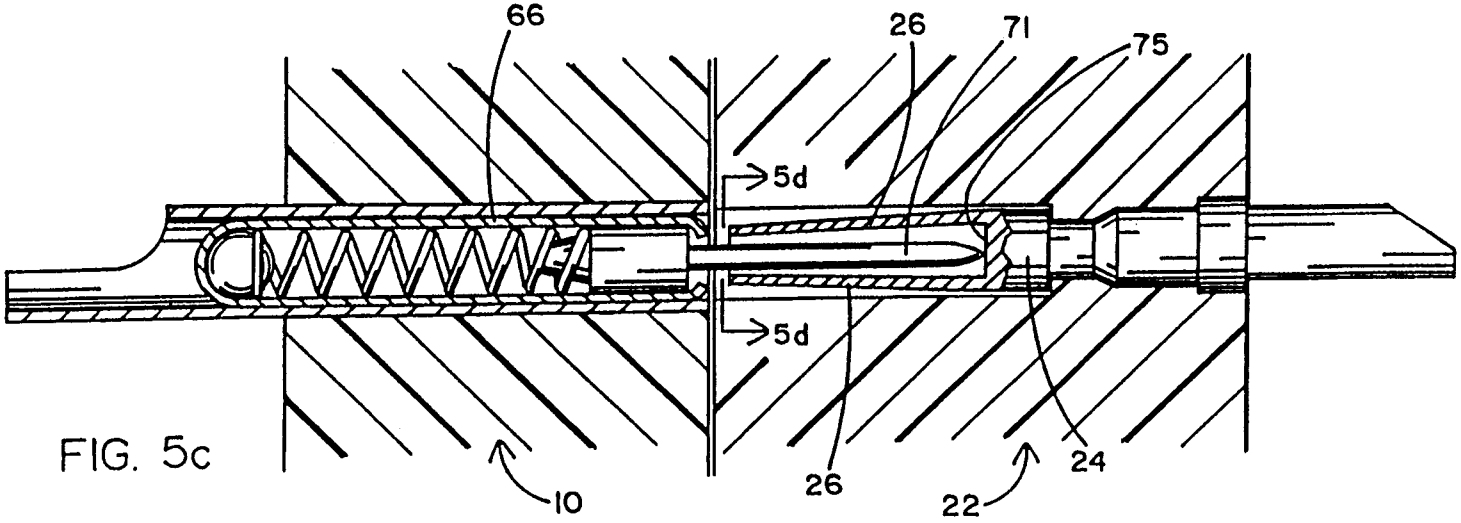
FIG. 5*c* is a fragmentary sectional view similar to FIG. 5*b* but showing a different type of pin.
Figure 5A:
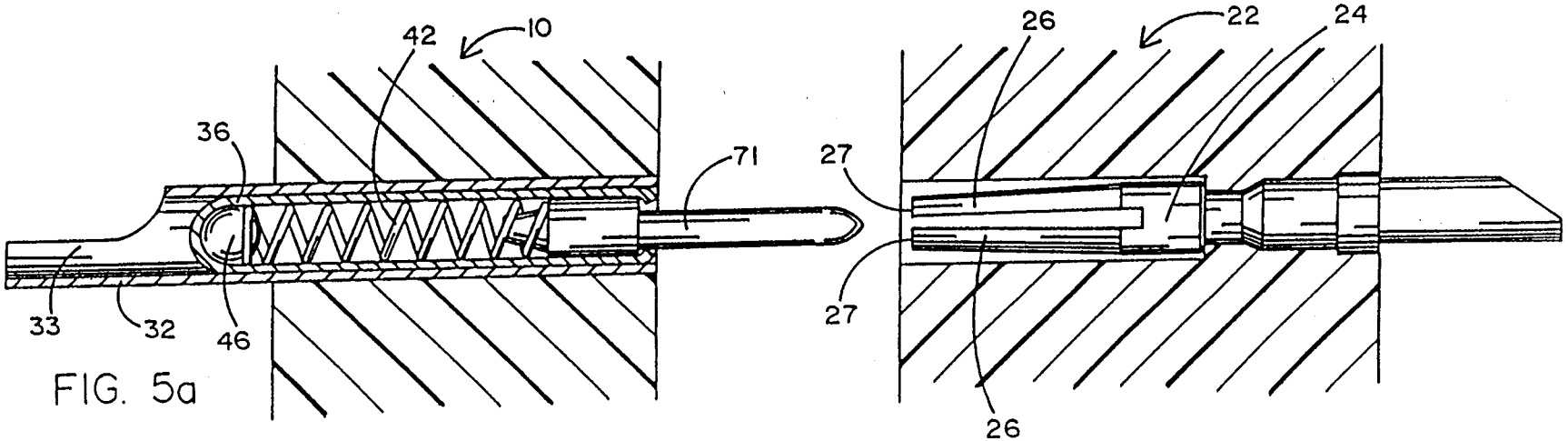
FIGS. 5*a* and 5*b* are sectional views, respectively, of an inventive male connector before and after mating with a conventional female connector.
Figure 5B:
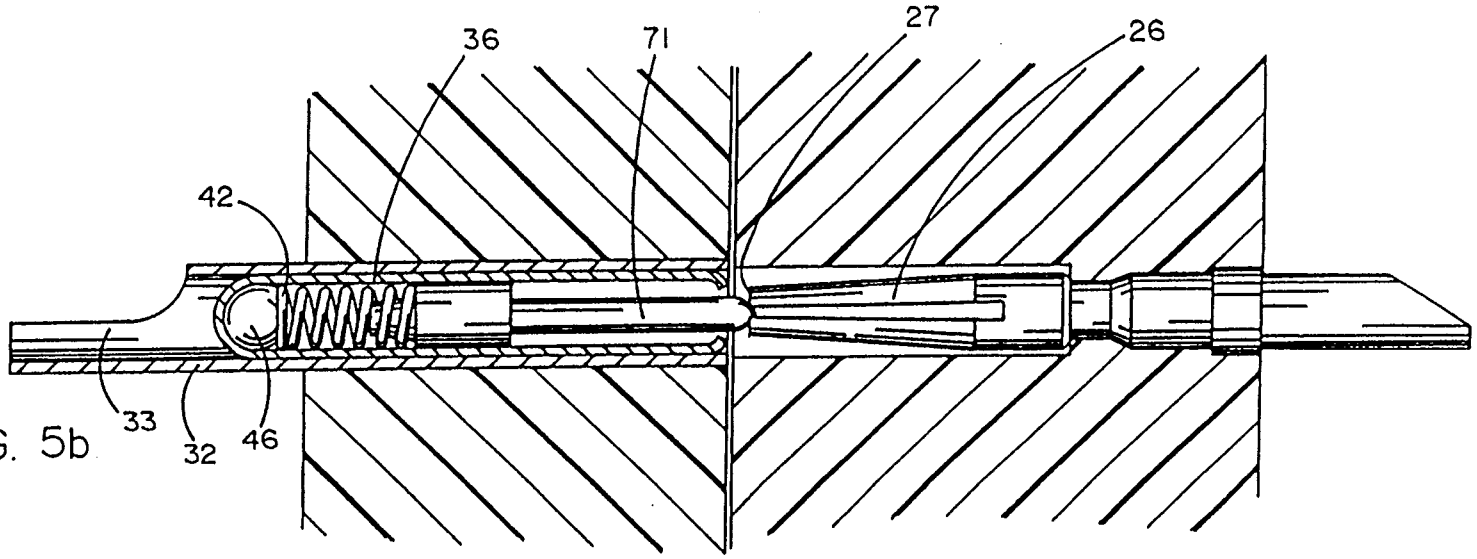
Figure 5D:
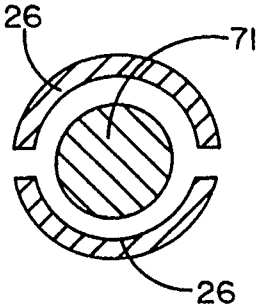
FIG. 5*d* is a section along line 5*d*—5*d* of FIG. 5*c;*

As shown in FIGS. 5*a* and 5*b*, spring-loaded male terminals such as the pin 71 are useful in high-cycle or frequent mating of a male connector with conventional female connectors. In that case, the spring 42 is advantageously weak enough to allow the pin 71 to bear against the edges 27 of the leaf springs 26 but not to penetrate between them. Alternatively, as shown in FIGS. 5*c* and 5*d*, the pin 71 may be made thin enough and long enough to pass between the leaf springs 26 without touching them, and to abut against the surface 75 of the socket 24.

Figure 6:
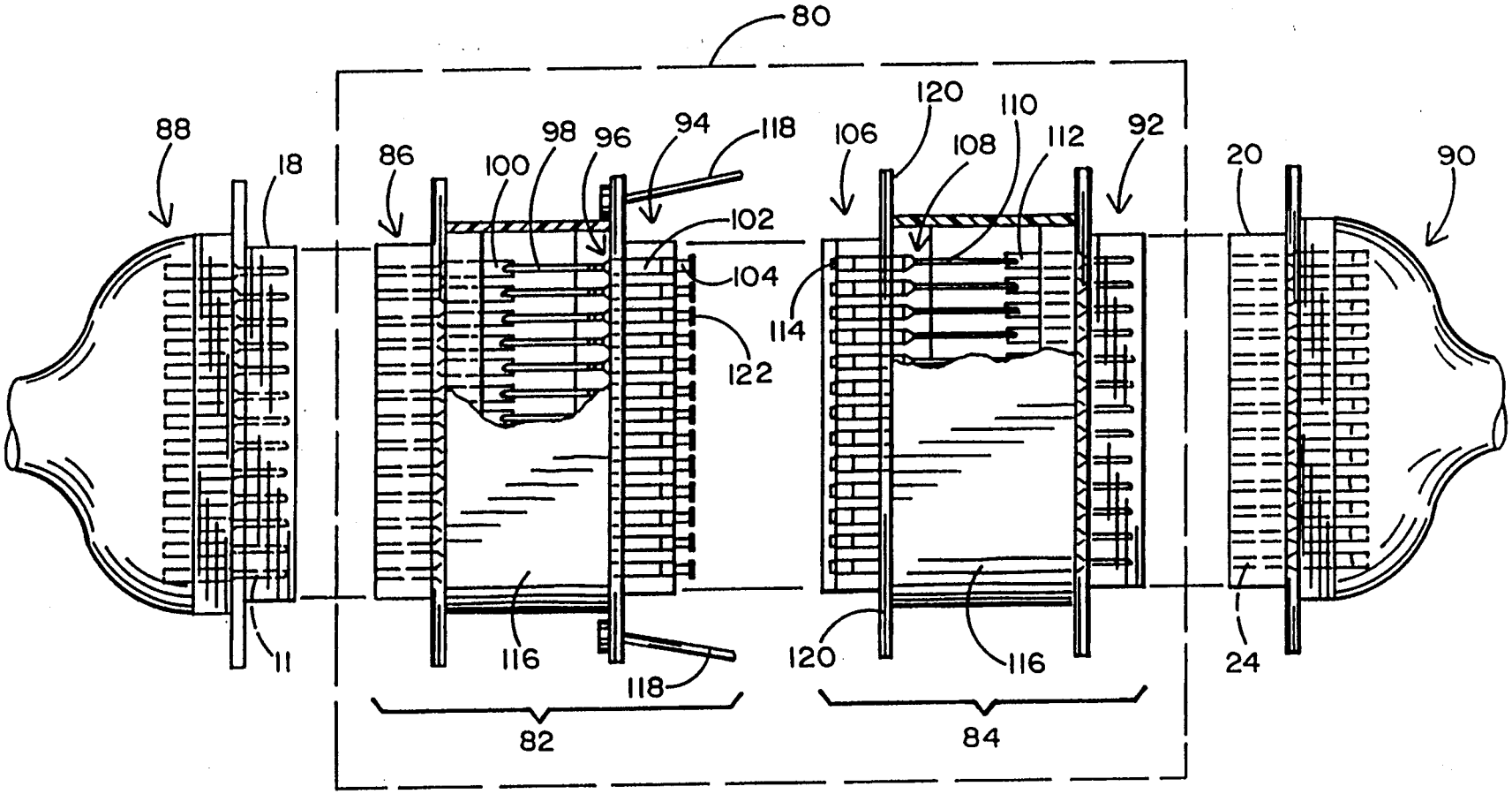
FIG. 6 is a sectional view of another embodiment of the invention.

FIG. 6 shows a version of the invention which is particularly useful as an adapter to convert existing D-SUB-type connectors or the like to high-cycle mating operations. In FIG. 6, an adapter system 80 consists of a pair of adapters 82, 84. The standard connector section 86 of adapter 82 is substantially permanently plugged into the male connector 88 of the standard connector set 88, 90 which is to be modified for frequent connection and disconnection. Likewise, the standard connector section 92 of the adapter 84 is substantially permanently plugged into the female connector 90 of the standard connector set 88, 90.

A spring probe block 94 has mounted therein a plurality of probe sockets 96 whose rear portions 98 are narrowed into the form of an elongated pin which fits into the connection elements 100 of the female standard connector section 86 of adapter 82. The front portions 102 of probe sockets 96 are formed to receive the barrels of spring probes 104 similar to the spring terminals 38 of FIGS. 3*a* and 3*b*.

Similarly, the stationary probe block 106 has mounted therein a plurality of probe sockets 108 substantially identical to the probe sockets 96. The pin-shaped rear portions 110 of probe sockets 108 are dimensioned to fit into the connection elements 112 of the male standard connector section 92. Although the probe sockets 108 may also contain spring probes, the preferred embodiment of FIG. 6 envisions the placement of stationary probes 114 into the probe sockets 108.

The elements 86 and 94 of adapter 82 are joined in any appropriate conventional manner, as are the elements 92 and 106 of adapter 84. The thus joined elements may be enclosed by an appropriate cover 116. Quick connect clamps 118 may be provided on adapter 82 to engage the flanges 120 of adapter 84 to hold the adapters 82, 84 together if desired.

The edge-rounded but generally flat heads 122 of the spring probes 104 shown in FIG. 6 illustrate the fact that the invention is not limited to the conical contact shapes discussed above in connection with FIGS. 3*a*, 3*b*, 4*a* and 4*b*.

Figure 7:
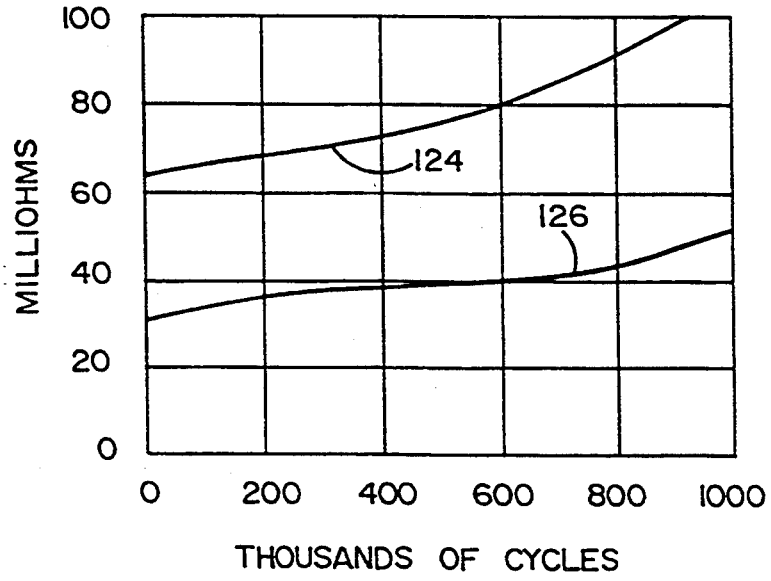
FIG. 7 is a graph illustrating the variation of contact resistance through the life of a connector constructed according to the invention.

The invention makes it possible, for example by the use of the adapter system 80, to extend the useful life of a signal cable connector such as a standard D-SUB-type connector from its rated life of about 500 cycles to about 10,000 cycles or about 100,000 cycles or more with no significant increase in contact resistance, and even to a million cycles with only about a 60% increase in contact resistance, as shown by FIG. 7. In that figure, curve 124 shows the contact resistance of nickel silver barrels with no finish, while curve 126 shows the contact resistance of nickel silver barrels with an interior cladding of precious metal.

Figure 8:
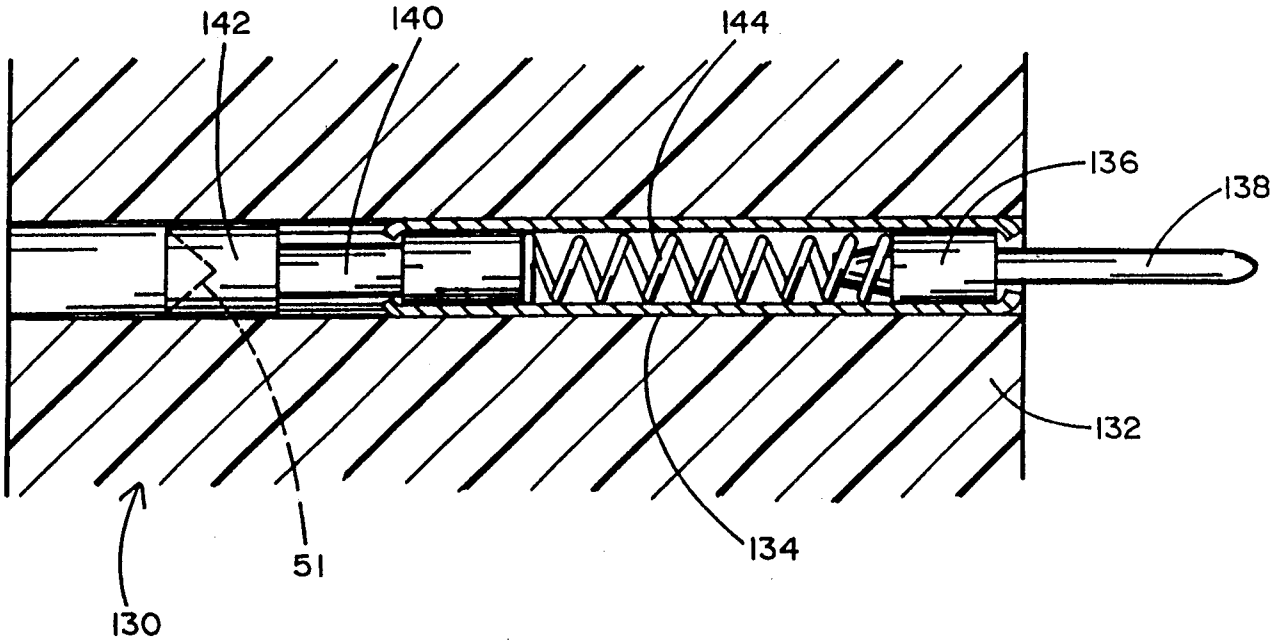
FIG. 8 is a sectional view of still another embodiment of the invention.

A further advantage can be gained by the use of a double ended spring-loaded connector such as that shown in FIG. 8. Particularly in test situations, it is sometimes desirable at one time to make numerous temporary connections from a single male connector to a multiplicity of female connectors, and at another time from a single female connector to a multiplicity of male connectors. Alternatively, it may be desirable to temporarily connect multiple pairs of male and female connectors through a stationary test fixture. The embodiment of FIG. 8 makes it possible to conveniently accomplish either of these tasks with a single, easily handled probe or double-ended adapter.

The double-ended adapter 130 includes a body 132 in which are disposed a plurality of barrels 134, each of which is equipped with a plunger 136 carrying a male terminal 138 at one end, and a plunger 140 carrying a female terminal 142 at the other end. The spring 144 extends between the plungers 136, 140 and urges them apart. The body 132 may be part of a test fixture to which connectors are applied simultaneously from both ends, or it may be equipped at each end with quick connect clamps (not shown in FIG. 8) similar to quick connect clamps 118 of FIG. 6, for a more permanent attachment of one end of the adapter 130 to a conventional signal cable connector. In a broader application of this concept, it will be understood that the plungers 136 and 140 of FIG. 8 may both be equipped with male or female terminals.

Another advantage of the spring-loaded construction shown and described herein is that on repetitive quick connections, the connectors of this invention need not be carefully aligned, i.e. they can be slightly tilted with respect to each other, and their pins and sockets will still make good contact because each individual terminal can compensate for such misalignment by moving to whatever position is necessary to assure good contact.

While this invention has been described with respect to various specific examples and embodiments, it is to be understood that the invention is not limited thereto and that it can be variously practiced within the scope of the following claims.

We claim:

1. An electrical signal cable connector for high-cycle connecting and disconnecting operations, comprising:

a. a body; and b. a plurality of biased terminals in said body, each of said terminals including;

a barrel, closed at one end and open at the other, located in said body;

a receptacle tube interposed between said body and said barrel, said barrel being secured to said receptacle tube;

a plunger disposed in said barrel for limited movement with respect thereto, said plunger having an outer end extending toward the open end of said barrel and carrying a contact head on said outer end; and a bias assembly interposed between said barrel and said plunger for biasing said plunger toward said open end of said barrel, said electrical signal cable connector capable of being effective and substantially undamaged after being connected and disconnected to and from at least one complementary electrical signal cable connector a number of times greater than the number of connecting-disconnecting cycles after which a D-SUB-type connector without such biased terminals is substantially damaged as a result of said number of connecting-disconnecting cycles, said number of times being a few hundred times.

2. The connector of claim 1, in which said contact head is male.

3. The connector of claim 2, in which said contact head has a substantially conical contact surface.

4. The connector of claim 1, in which said contact head is female.

5. The connector of claim 4, in which said contact head has a substantially conical recessed contact surface.

6. The connector of claim 1, in which said barrel is substantially hemispherical at its closed end, and a ball is interposed between said bias assembly and said barrel at said closed end.

7. The connector of claim 1, after being connected and disconnected to and from at least one complimentary electrical signal cable connector said number of times.

8. The connector of claim 1, wherein said number of times is about 500, and said barrel is stationary relative to said body.

9. The connector of claim 1 wherein said number of times is thousands.

10. The connector of claim 1 wherein said number of times is at least about ten thousand.

11. An electrical signal cable connector for high-cycle connecting and disconnecting operations, comprising:

a. a body; and b. a plurality of biased terminals in said body, each of said terminals including;

a barrel, closed at one end and open at the other end and being substantially hemispherical at its closed end, located in said body;

a plunger disposed ill said barrel for limited movement with respect thereto, said plunger having an outer end extending toward the open end of said barrel and carrying a contact head on said outer end; and a bias assembly interposed between said barrel and said plunger for biasing said plunger toward said open end of said barrel, and a ball interposed between said bias assembly and said barrel at said closed end, said electrical signal cable connector capable of being effective and substantially undamaged after being connected and disconnected to and from at least one complementary electrical signal cable connector a number of times greater than the number of connecting-disconnecting cycles after which a D-SUB-type connector without such biased terminals is substantially damaged as a result of said number of connecting-disconnecting cycles.

* * * * *